US008928256B2

(12) United States Patent
Smith

(10) Patent No.: US 8,928,256 B2
(45) Date of Patent: Jan. 6, 2015

(54) METHOD AND SYSTEM FOR LIGHT ARRAY THERMAL SLOPE DETECTION

(71) Applicant: Phoseon Technology, Inc., Hillsboro, OR (US)

(72) Inventor: Jeff Smith, Hillsboro, OR (US)

(73) Assignee: Phoseon Technology, Inc., Hillsboro, OR (US)

( * ) Notice: Subject to any disclaimer, the term of this patent is extended or adjusted under 35 U.S.C. 154(b) by 60 days.

(21) Appl. No.: 13/890,076

(22) Filed: May 8, 2013

(65) Prior Publication Data

US 2014/0320019 A1 Oct. 30, 2014

Related U.S. Application Data

(60) Provisional application No. 61/816,418, filed on Apr. 26, 2013.

(51) Int. Cl.
*H05B 37/02* (2006.01)
*H05B 33/08* (2006.01)

(52) U.S. Cl.
CPC ..... *H05B 33/0842* (2013.01)
USPC ..... 315/309; 315/112; 315/224

(58) Field of Classification Search
USPC ..... 315/112, 117, 118, 224, 307, 308, 309
See application file for complete search history.

(56) References Cited

U.S. PATENT DOCUMENTS

| | | | | |
|---|---|---|---|---|
| 6,419,873 | B1 | 7/2002 | Buazza et al. | |
| 7,132,805 | B2 * | 11/2006 | Young | 315/308 |
| 7,167,773 | B2 | 1/2007 | Schneider et al. | |
| 8,350,489 | B2 * | 1/2013 | Yamauchi et al. | 315/224 |
| 2002/0047546 | A1 * | 4/2002 | Kayser | 315/117 |
| 2010/0045194 | A1 | 2/2010 | Peker et al. | |
| 2011/0080116 | A1 | 4/2011 | Negley et al. | |
| 2011/0115383 | A1 | 5/2011 | Tyson, III et al. | |
| 2011/0199013 | A1 | 8/2011 | Cottrell | |
| 2011/0241548 | A1 | 10/2011 | Tsai | |

OTHER PUBLICATIONS

ISA Korean Intellectual Property Office, International Search Report and Written Opinion in PCT/US2014/033359, Aug. 21, 2014, WIPO, 13 pages.

* cited by examiner

*Primary Examiner* — David H Vu
(74) *Attorney, Agent, or Firm* — Alleman Hall McCoy Russell & Tuttle LLP

(57) ABSTRACT

A system and method for operating one or more light emitting devices is disclosed. In one example, the light emitting devices may be deactivated in response to a rate of temperature rise of the light emitting devices. The system and method further include a way of reducing false positive indications of light emitting device.

20 Claims, 5 Drawing Sheets

METHOD AND SYSTEM FOR LIGHT ARRAY THERMAL SLOPE DETECTION

CROSS-REFERENCE TO RELATED APPLICATIONS

This application claims priority to U.S. Provisional Patent Application No. 61/816,418, entitled "Method and System for Light Array Thermal Slope Detection," filed Apr. 26, 2013, the entirety of which is hereby incorporated by reference for all purposes.

BACKGROUND/SUMMARY

Solid-state lighting devices such as light emitting diodes (LEDs) may transmit ultraviolet (UV) light for curing photo sensitive media such as coatings, including inks, adhesives, preservatives, etc. Curing time of these photo sensitive media may be controlled via adjusting intensity of light directed at the photo sensitive media from the solid-state lighting device. The light intensity may be adjusted by increasing current flow to the solid-state lighting devices. However, as the power supplied to the solid-state lighting devices increases, the thermal output from the solid-state lighting devices also increases. If heat is not transferred away from the solid-state devices, their performance may degrade. One way to transfer heat away from a solid-state device is to transfer heat from the solid-state device to a liquid medium. For example, LEDs may be mounted to one side of a heat sink that includes a channel that holds a liquid medium. The liquid flows through the heat sink and transfers heat away from the heat sink and the LEDs to a remote area where the heat may be extracted from the liquid medium. Such a cooling system may remove a desired amount of heat from LEDs during most conditions. Nevertheless, if coolant flow becomes restricted or reduced, LEDs operation may degrade.

The inventor herein has recognized the above-mentioned issues and has developed a method for operating a plurality of light emitting devices, comprising: supplying an electrical current to the plurality of light emitting devices; and stopping flow of the electrical current in response to a rate of temperature increase of the plurality of light emitting devices exceeding a threshold rate of temperature increase.

By controlling current flow through a plurality of light emitting devices in response to a rate of temperature increase of the plurality of light emitting devices, it may be possible to shutdown operation of the plurality of light emitting devices before one or more of the plurality of light emitting devices experiences thermal degradation. For example, a temperature sensing device may be in thermal communication with a heat sink. Light emitting devices may be coupled to the heat sink so that heat is transferred from the light emitting devices to the heat sink. The heat sink temperature may be indicative of light emitting device temperature. If the heat sink temperature increases at a rate that is greater than a threshold rate of temperature increase, electrical current flowing to the light emitting devices may be stopped to reduce the possibility of the light emitting devices degrading.

The present description may provide several advantages. In particular, the approach may provide improved temperature control response. Further, the approach may be useful for reducing the possibility of light emitting device degradation. Further still, the approach may be applied to a system that monitors one or more light emitting device via one or more temperature sensing devices.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
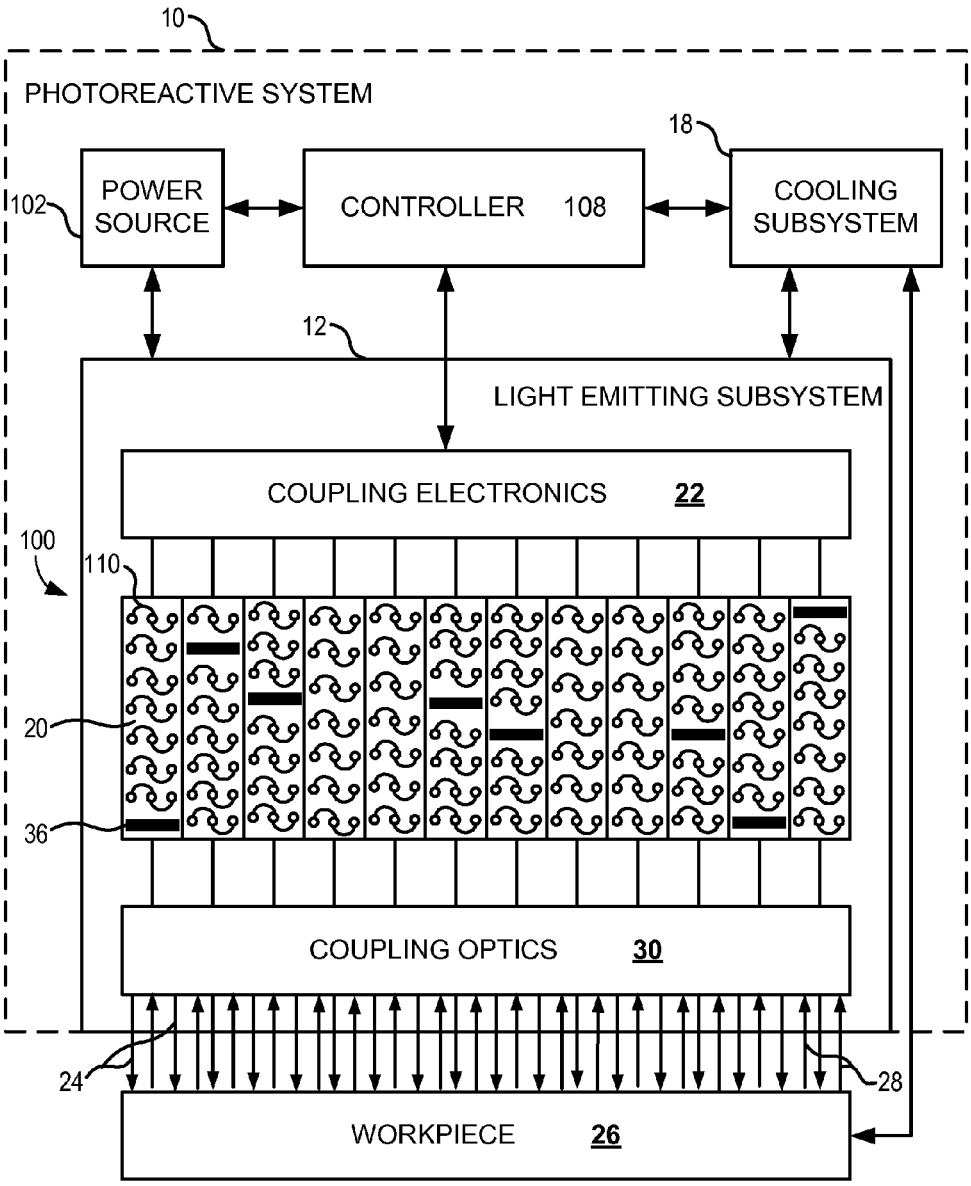
FIG. 1 shows a schematic depiction of a lighting system.
Figure 2:
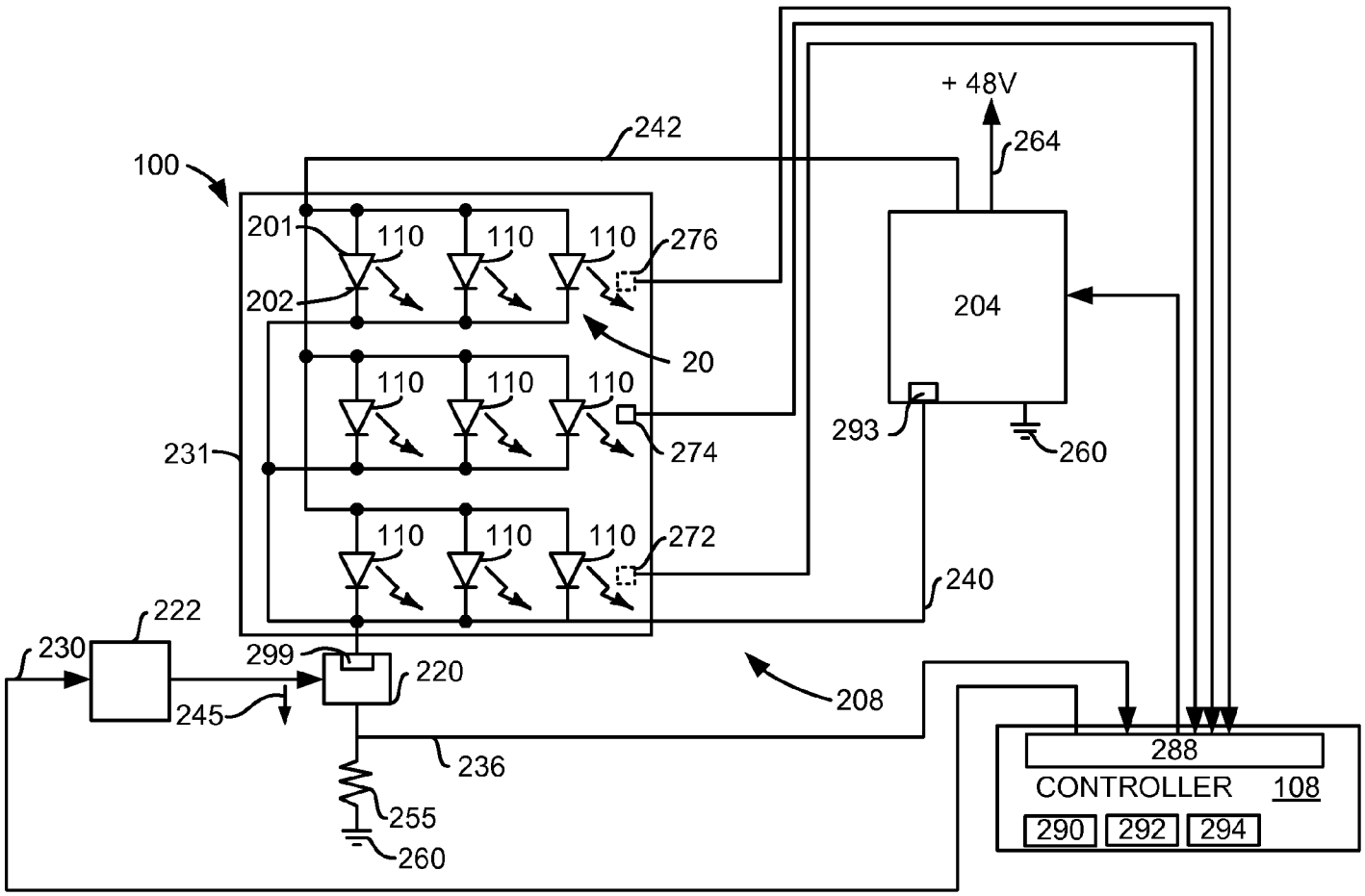
FIG. 2 shows a schematic of example lighting system.
Figure 3:
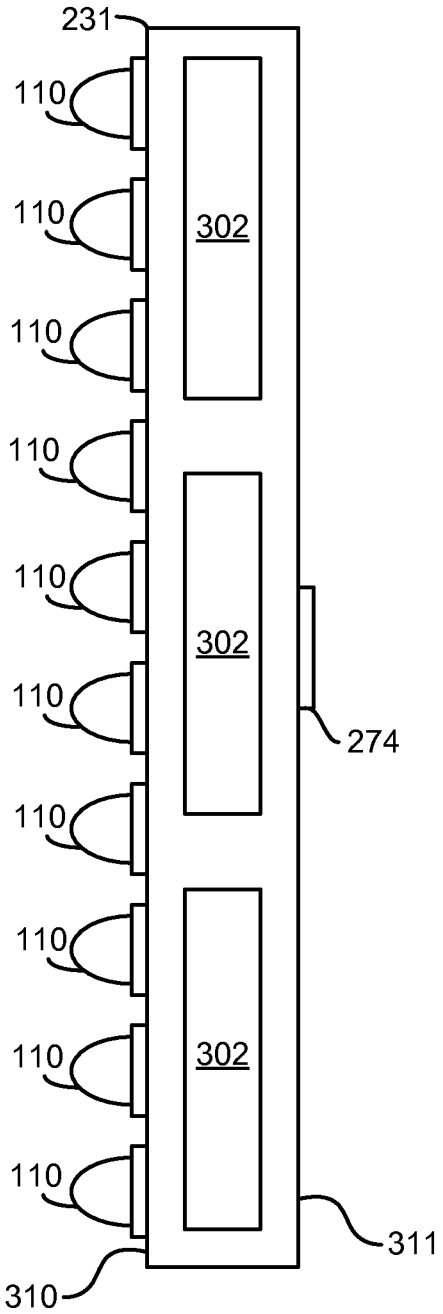
FIG. 3 shows an example cross section of a lighting system heat sink.

The present description is related to a lighting system including a thermal management system. FIG. 1 shows one example lighting system which includes a thermal management system. The lighting system may have an electrical layout as shown in the schematic of FIG. 2. The lighting system may also include a heat sink for carrying heat away from light emitting devices as is shown in FIG. 3. The lighting system may operate according to the method shown in FIG. 4. Finally, the method of FIG. 4 and the system of FIGS. 1-3 may operate according to the sequence shown in FIG. 5.

Referring now to FIG. 1, a block diagram of a photoreactive system 10 in accordance with the system and method described herein is shown. In this example, the photoreactive system 10 comprises a lighting subsystem 100, a controller 108, a power source 102 and a cooling subsystem 18.

The lighting subsystem 100 may comprise a plurality of light emitting devices 110. Light emitting devices 110 may be LED devices, for example. Selected of the plurality of light emitting devices 110 are implemented to provide radiant output 24. The radiant output 24 is directed to a work piece 26. Returned radiation 28 may be directed back to the lighting subsystem 100 from the work piece 26 (e.g., via reflection of the radiant output 24).

The radiant output 24 may be directed to the work piece 26 via coupling optics 30. The coupling optics 30, if used, may be variously implemented. As an example, the coupling optics may include one or more layers, materials or other structure interposed between the light emitting devices 110 providing radiant output 24 and the work piece 26. As an example, the coupling optics 30 may include a micro-lens array to enhance collection, condensing, collimation or otherwise the quality or effective quantity of the radiant output 24. As another example, the coupling optics 30 may include a micro-reflector array. In employing such micro-reflector array, each semiconductor device providing radiant output 24 may be disposed in a respective micro-reflector, on a one-to-one basis.

Each of the layers, materials or other structure may have a selected index of refraction. By properly selecting each index of refraction, reflection at interfaces between layers, materials and other structure in the path of the radiant output 24 (and/or returned radiation 28) may be selectively controlled.

As an example, by controlling differences in such indexes of refraction at a selected interface disposed between the semiconductor devices to the work piece 26, reflection at that interface may be reduced, eliminated, or minimized, so as to enhance the transmission of radiant output at that interface for ultimate delivery to the work piece 26.

The coupling optics 30 may be employed for various purposes. Example purposes include, among others, to protect the light emitting devices 110, to retain cooling fluid associated with the cooling subsystem 18, to collect, condense and/or collimate the radiant output 24, to collect, direct or reject returned radiation 28, or for other purposes, alone or in combination. As a further example, the photoreactive system 10 may employ coupling optics 30 so as to enhance the effective quality or quantity of the radiant output 24, particularly as delivered to the work piece 26.

Selected of the plurality of light emitting devices 110 may be coupled to the controller 108 via coupling electronics 22, so as to provide data to the controller 108. As described further below, the controller 108 may also be implemented to control such data-providing semiconductor devices, e.g., via the coupling electronics 22.

The controller 108 preferably is also connected to, and is implemented to control, each of the power source 102 and the cooling subsystem 18. Moreover, the controller 108 may receive data from power source 102 and cooling subsystem 18.

The data received by the controller 108 from one or more of the power source 102, the cooling subsystem 18, the lighting subsystem 100 may be of various types. As an example, the data may be representative of one or more characteristics associated with coupled semiconductor devices 110, respectively. As another example, the data may be representative of one or more characteristics associated with the respective component 12, 102, 18 providing the data. As still another example, the data may be representative of one or more characteristics associated with the work piece 26 (e.g., representative of the radiant output energy or spectral component(s) directed to the work piece). Moreover, the data may be representative of some combination of these characteristics.

The controller 108, in receipt of any such data, may be implemented to respond to that data. For example, responsive to such data from any such component, the controller 108 may be implemented to control one or more of the power source 102, cooling subsystem 18, and lighting subsystem 100 (including one or more such coupled semiconductor devices). As an example, responsive to data from the lighting subsystem indicating that the light energy is insufficient at one or more points associated with the work piece, the controller 108 may be implemented to either (a) increase the power source's supply of current and/or voltage to one or more of the semiconductor devices 110, (b) increase cooling of the lighting subsystem via the cooling subsystem 18 (i.e., certain light emitting devices, if cooled, provide greater radiant output), (c) increase the time during which the power is supplied to such devices, or (d) a combination of the above.

Individual semiconductor devices 110 (e.g., LED devices) of the lighting subsystem 100 may be controlled independently by controller 108. For example, controller 108 may control a first group of one or more individual LED devices to emit light of a first intensity, wavelength, and the like, while controlling a second group of one or more individual LED devices to emit light of a different intensity, wavelength, and the like. The first group of one or more individual LED devices may be within the same array of semiconductor devices 110, or may be from more than one array of semiconductor devices 110. Arrays of semiconductor devices 110 may also be controlled independently by controller 108 from other arrays of semiconductor devices 110 in lighting subsystem 100 by controller 108. For example, the semiconductor devices of a first array may be controlled to emit light of a first intensity, wavelength, and the like, while those of a second array may be controlled to emit light of a second intensity, wavelength, and the like.

As a further example, under a first set of conditions (e.g. for a specific work piece, photoreaction, and/or set of operating conditions) controller 108 may operate photoreactive system 10 to implement a first control strategy, whereas under a second set of conditions (e.g. for a specific work piece, photoreaction, and/or set of operating conditions) controller 108 may operate photoreactive system 10 to implement a second control strategy. As described above, the first control strategy may include operating a first group of one or more individual semiconductor devices (e.g., LED devices) to emit light of a first intensity, wavelength, and the like, while the second control strategy may include operating a second group of one or more individual LED devices to emit light of a second intensity, wavelength, and the like. The first group of LED devices may be the same group of LED devices as the second group, and may span one or more arrays of LED devices, or may be a different group of LED devices from the second group, and the different group of LED devices may include a subset of one or more LED devices from the second group.

The cooling subsystem 18 is implemented to manage the thermal behavior of the lighting subsystem 100. For example, generally, the cooling subsystem 18 provides for cooling of such subsystem 12 and, more specifically, the semiconductor devices 110. The cooling subsystem 18 may also be implemented to cool the work piece 26 and/or the space between the piece 26 and the photoreactive system 10 (e.g., particularly, the lighting subsystem 100). For example, cooling subsystem 18 may be an air or other fluid (e.g., water) cooling system. In some examples, the cooling system 18 may include a heat as shown in FIG. 3.

The photoreactive system 10 may be used for various applications. Examples include, without limitation, curing applications ranging from ink printing to the fabrication of DVDs and lithography. Generally, the applications in which the photoreactive system 10 is employed have associated parameters. That is, an application may include associated operating parameters as follows: provision of one or more levels of radiant power, at one or more wavelengths, applied over one or more periods of time. In order to properly accomplish the photoreaction associated with the application, optical power may need to be delivered at or near the work piece at or above a one or more predetermined levels of one or a plurality of these parameters (and/or for a certain time, times or range of times).

In order to follow an intended application's parameters, the semiconductor devices 110 providing radiant output 24 may be operated in accordance with various characteristics associated with the application's parameters, e.g., temperature, spectral distribution and radiant power. At the same time, the semiconductor devices 110 may have certain operating specifications, which may be are associated with the semiconductor devices' fabrication and, among other things, may be followed in order to preclude destruction and/or forestall degradation of the devices. Other components of the photoreactive system 10 may also have associated operating specifications. These specifications may include ranges (e.g., maximum and minimum) for operating temperatures and applied, electrical power, among other parameter specifications.

Accordingly, the photoreactive system 10 supports monitoring of the application's parameters. In addition, the photoreactive system 10 may provide for monitoring of semiconductor devices 110, including their respective characteristics and specifications. Moreover, the photoreactive system 10 may also provide for monitoring of selected other components of the photoreactive system 10, including their respective characteristics and specifications.

Providing such monitoring may enable verification of the system's proper operation so that operation of photoreactive system 10 may be reliably evaluated. For example, the system 10 may be operating in an undesirable way with respect to one or more of the application's parameters (e.g., temperature, radiant power, etc.), any components characteristics associated with such parameters and/or any component's respective operating specifications. The provision of monitoring may be responsive and carried out in accordance with the data received by controller 108 by one or more of the system's components.

Monitoring may also support control of the system's operation. For example, a control strategy may be implemented via the controller 108 receiving and being responsive to data from one or more system components. This control, as described above, may be implemented directly (i.e., by controlling a component through control signals directed to the component, based on data respecting that components operation) or indirectly (i.e., by controlling a component's operation through control signals directed to adjust operation of other components). As an example, a semiconductor device's radiant output may be adjusted indirectly through control signals directed to the power source 102 that adjust power applied to the lighting subsystem 100 and/or through control signals directed to the cooling subsystem 18 that adjust cooling applied to the lighting subsystem 100.

Control strategies may be employed to enable and/or enhance the system's proper operation and/or performance of the application. In a more specific example, control may also be employed to enable and/or enhance balance between the array's radiant output and its operating temperature, so as, e.g., to preclude heating the semiconductor devices 110 or array of semiconductor devices 110 beyond their specifications while also directing radiant energy to the work piece 26 sufficient to properly complete the photoreaction(s) of the application.

In some applications, high radiant power may be delivered to the work piece 26. Accordingly, the subsystem 12 may be implemented using an array of light emitting semiconductor devices 110. For example, the subsystem 12 may be implemented using a high-density, light emitting diode (LED) array. Although LED arrays may be used and are described in detail herein, it is understood that the semiconductor devices 110, and array(s) of same, may be implemented using other light emitting technologies without departing from the principles of the description, examples of other light emitting technologies include, without limitation, organic LEDs, laser diodes, other semiconductor lasers.

The plurality of semiconductor devices 110 may be provided in the form of an array 20, or an array of arrays. The array 20 may be implemented so that one or more, or most of the semiconductor devices 110 are configured to provide radiant output. At the same time, however, one or more of the array's semiconductor devices 110 are implemented so as to provide for monitoring selected of the array's characteristics. The monitoring devices 36 may be selected from among the devices in the array 20 and, for example, may have the same structure as the other, emitting devices. For example, the difference between emitting and monitoring may be determined by the coupling electronics 22 associated with the particular semiconductor device (e.g., in a basic form, an LED array may have monitoring LEDs where the coupling electronics provides a reverse current, and emitting LEDs where the coupling electronics provides a forward current).

Furthermore, based on coupling electronics, selected of the semiconductor devices in the array 20 may be either/both multifunction devices and/or multimode devices, where (a) multifunction devices are capable of detecting more than one characteristic (e.g., either radiant output, temperature, magnetic fields, vibration, pressure, acceleration, and other mechanical forces or deformations) and may be switched among these detection functions in accordance with the application parameters or other determinative factors and (b) multimode devices are capable of emission, detection and some other mode (e.g., off) and are switched among modes in accordance with the application parameters or other determinative factors.

Referring to FIG. 2, a schematic of a first lighting system circuit that may supply varying amounts of current is shown. Lighting system 100 includes one or more light emitting devices 110. In this example, light emitting devices 110 are light emitting diodes (LEDs). Each LED 110 includes an anode 201 and a cathode 202. Switching power source 102 shown in FIG. 1 supplies 48V DC power to voltage regulator 204 via path or conductor 264. Voltage regulator 204 supplies DC power to the anodes 201 of LEDs 110 via conductor or path 242. Voltage regulator 204 is also electrically coupled to cathodes 202 of LEDs 110 via conductor or path 240. Voltage regulator 204 is shown referenced to ground 260 and may be a buck regulator in one example. Controller 108 is shown in electrical communication with voltage regulator 204. In other examples, discrete input generating devices (e.g., switches) may replace controller 108, if desired. Controller 108 includes central processing unit (CPU) 290 for executing instructions. Controller 108 also includes inputs and outputs (I/O) 288 for operating voltage regulator 204 and other devices. Non-transitory executable instructions may be stored in read only memory 292 while variables may be stored in random access memory 294. Voltage regulator 204 supplies an adjustable voltage to LEDs 110.

Switching device or variable resistor 220 in the form of a field-effect transistor (FET) receives an intensity signal voltage from controller 108 or via another input device. While the present example describes the variable resistor as an FET, one must note that the circuit may employ other forms of variable resistors.

In this example, at least one element of array 20 includes solid-state light-emitting elements such as light-emitting diodes (LEDs) or laser diodes that produce light. The elements may be configured as a single array on a substrate, multiple arrays on a substrate, several arrays either single or multiple on several substrates connected together, etc. In one example, the array of light-emitting elements may consist of a Silicon Light Matrix™ (SLM) manufactured by Phoseon Technology, Inc.

Controller 108 also receives temperature data from temperature sensors 272, 274, and 276. Temperature sensors 276 and 272 are optional. Further, if desired, lighting system may include a greater or less number of temperature sensors. Temperature sensors may be in thermal communication with a heat sink 231 as shown in greater detail in FIG. 3. Temperature sensors 272, 274, and 276 provide an indication of the temperatures of LEDs 110.

The circuit shown in FIG. 2 is a closed loop current control circuit 208. In closed loop circuit 208, the variable resistor 220 receives an intensity voltage control signal via conductor or path 230 through the drive circuit 222. The variable resistor 220 receives its drive signal from the driver 222. Voltage between variable resistor 220 and array 20 is controlled to a desired voltage as determined by voltage regulator 204. The desired voltage value may be supplied by controller 108 or another device, and voltage regulator 204 controls voltage signal 242 to a level that provides the desired voltage in a current path between array 20 and variable resistor 220. Variable resistor 220 controls current flow from array 20 to current sense resistor 255 in the direction of arrow 245.

The desired voltage may also be adjusted responsive to the type of lighting device, type of work piece, curing parameters, and various other operating conditions. An electrical current signal may be fed back along conductor or path 236 to controller 108 or another device that adjusts the intensity voltage control signal provided. In particular, if the electrical current signal is different from a desired electrical current, the intensity voltage control signal passed via conductor 230 is increased or decreased to adjust electrical current through array 20. A feedback current signal indicative of electrical current flow through array 20 is directed via conductor 236. The feedback current signal is a voltage level that changes as electrical current flowing through current sense resistor 255 changes.

Controller 108 may also increase the resistance of variable resistor 220 to operate it as a switch and stop current flow through LEDs 110 when one or more of temperature sensors 272, 274, and 276 indicate a LED temperature that is greater than a threshold temperature. Further, controller 108 may operate according to the method of FIG. 4 to stop current flow through LEDs 110 when a rate of temperature change of the LEDs is greater than a threshold rate of temperature change.

In one example where the voltage between variable resistor 220 and array 20 is adjusted to a constant voltage, current flow through array 20 and variable resistor 220 is adjusted via adjusting the resistance of variable resistor 220. Thus, a voltage signal carried along conductor 240 from the variable resistor 220 does not go to the array 20 in this example. Instead, the voltage feedback between array 20 and variable resistor 220 follows conductor 240 and goes to the voltage regulator 204. The voltage regulator 204 then outputs a voltage signal 242 to the array 20. Consequently, voltage regulator 204 adjusts its output voltage in response to a voltage downstream of array 20, and current flow through array 20 is adjusted via variable resistor 220. Controller 108 may include instructions to adjust a resistance value of variable resistor 220 in response to array current fed back as a voltage via conductor 236. Conductor 240 allows electrical communication between the cathodes 202 of LEDs 110, input 299 (e.g., a drain of an N-channel MOSFET) of variable resistor 220, and voltage feedback input 293 of voltage regulator 204. Thus, the cathodes 202 of LEDs 110 an input side 299 of variable resistor 220 and voltage feedback input 293 are at the same voltage potential.

The variable resistor may take the form of an FET, a bipolar transistor, a digital potentiometer or any electrically controllable, current limiting device. Alternatively, a manually controllable current limiting device may be used as the variable resistor. The drive circuit may take different forms depending upon the variable resistor used. The closed loop system operates such that an output voltage regulator 204 remains about 0.5 V above a voltage to operate array 20. The regulator output voltage adjusts voltage applied to array 20 and the variable resistor controls current flow through array 20 to a desired level. The present circuit may increase lighting system efficiency and reduce heat generated by the lighting system as compared to other approaches. In the example of FIG. 2, the variable resistor 220 typically produces a voltage drop in the range of 0.6V. However, the voltage drop at variable resistor 220 may be less or greater than 0.6V depending on the variable resistor's design.

Referring now to FIG. 3, a cross section of an example lighting system heat sink 231 is shown. LEDs 110 are mechanically coupled to and are in thermal communication with a front side 310 of heat sink 231. Temperature sensing device 274 is mechanically coupled to and in thermal communication with back side 311 of heat sink 231. Heat sink 231 includes coolant passages 302 for directing coolant through heat sink 231. Heat sink 231 may be part of cooling subsystem 18 shown in FIG. 1. Heat generated by LEDs 110 may be transferred to heat sink 231 and transported away from heat sink 231 via coolant flowing through coolant passages 302. The temperature sensed by temperature sensor 274 may be indicative of a temperature of coolant flowing through coolant passages 302 and a temperature of LEDs 110. Temperature sensor 274 outputs a voltage that is proportional to a temperature sensed at the location of temperature sensor 274.

Thus, the lighting system of FIGS. 1-3 provides for operating light emitting devices, comprising: a DC power supply; a plurality of light emitting devices selectively receiving electrical current from the DC power supply; and a controller including executable instructions stored in non-transitory memory for stopping the electrical current from the DC power supply to the plurality of light emitting devices in response to a rate of temperature increase of the plurality of light emitting devices. The system further comprises additional executable instructions for sampling a temperature of the plurality of light emitting devices and requiring a temperature of the plurality of light emitting diodes to exceed a threshold temperature while the rate of light emitting device temperature increase exceeds a threshold rate of temperature increase before stopping flow of the electrical current In some examples, the system further comprises an electrical switch and additional executable instructions for stopping electrical current flow from the DC power supply to the plurality of light emitting devices via the electrical switch. The system further comprises additional executable instructions for stopping the electrical current flow in response to two consecutive indications of exceeding a threshold rate of temperature increase without the rate of temperature increase of the plurality of light emitting devices decreasing to a value less than the threshold rate of temperature increase. The system further comprises additional executable instructions for stopping flow of the electrical current until the DC power supply providing the electrical current is cycled off and on. The system also further comprises additional executable instructions for indicating a condition of light emitting device degradation when the rate of temperature increase of the plurality of light emitting devices exceeds a threshold rate of temperature increase. The system further comprises additional executable instructions for continuing to operate the DC power supply after stopping the electrical current.

Figure 4:
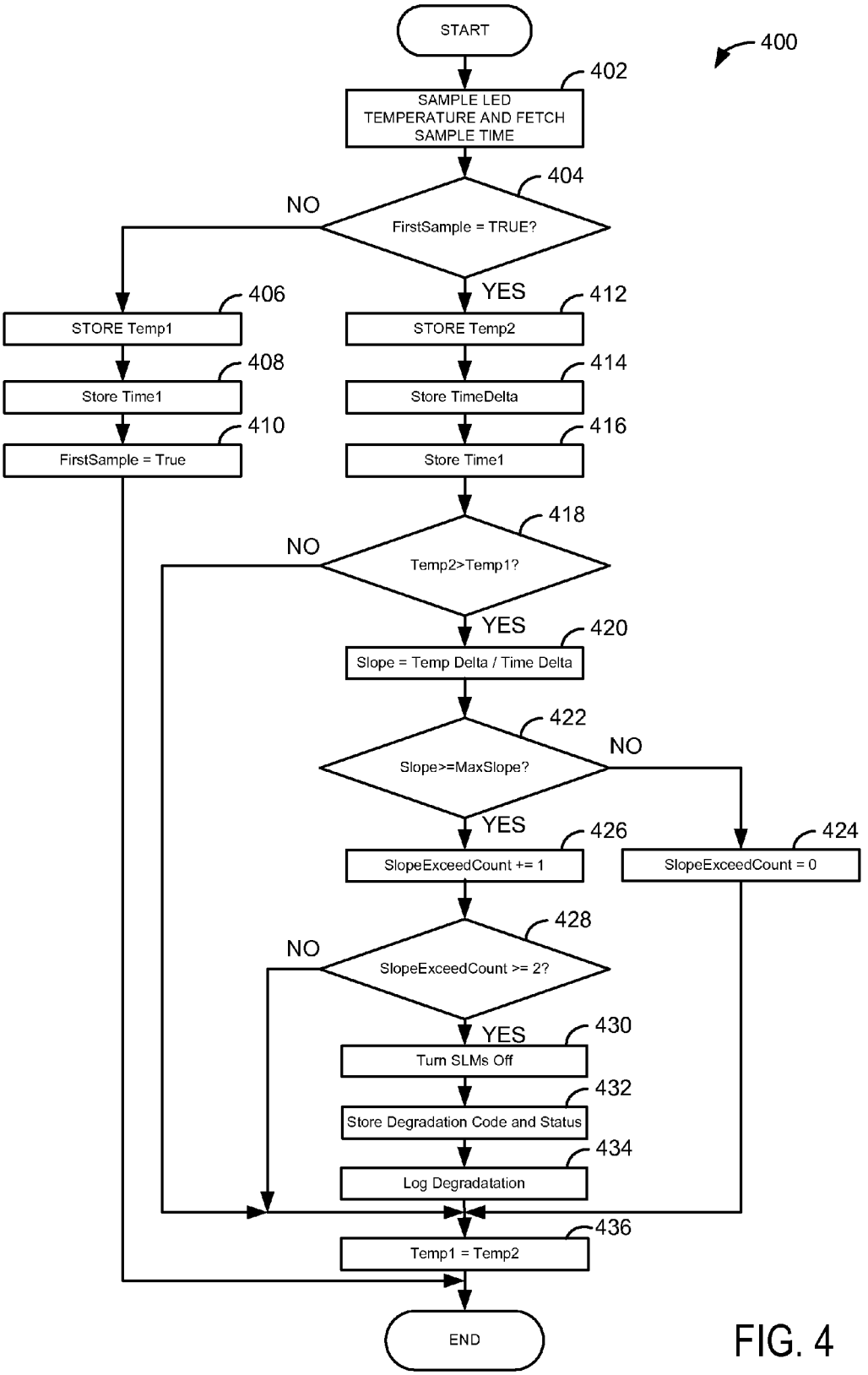
FIG. 4 shows an example method for operating a lighting system.

Referring now to FIG. 4, a method for operating a lighting system is shown. The method of FIG. 4 may be stored as executable instructions in non-transitory memory of controller 108 shown in FIG. 1. Further, the method of FIG. 4 may provide the operating sequence shown in FIG. 5 when it is executed via the lighting system shown in FIGS. 1-3. In some examples, the method of FIG. 4 may be executed once for each temperature sensor in the lighting system shown in FIGS. 1-3 such that current flow supplied to LEDs 110 may be stopped or reduced to a predetermined amount whenever a temperature at a temperature sensor increases at a rate greater than a threshold rate or when the temperature at the temperature sensor exceeds a threshold temperature.

At 402, method 400 samples a temperature of one or more light emitting devices. In one example, a temperature sensor in thermal communication with a heat sink provides an indication of light emitting device temperature to a controller. The controller samples a voltage output from the temperature sensor and stores a value representing the sampled temperature in one of four memory locations. The memory may be in the form of a first-in-first-out (FIFO) memory. Each time a new temperature sample is taken, it is loaded into the memory and the oldest temperature sample is discarded. The four sampled values stored in the memory are averaged to provide a light emitting device temperature for use in method 400. It should be noted that this example describes where four samples are stored in four memory locations, but in other examples, the number of samples and memory locations may vary from 1 to N. In examples where more than one temperature sensor is used, the sampled temperature may represent a temperature of a zone in the lighting array. Thus, the light emitting device temperature may be a single temperature corresponding to a temperature representative of all light emitting devices in an array. Alternatively, the temperature may be a single temperature representative of a temperature of a single light emitting device or a temperature of a subgroup of light emitting devices. Method 400 proceeds to 404 after the light emitting device temperature is determined.

At 404, method 400 judges whether or not a variable FirstSample is true or false. The variable FirstSample is representative of whether or not only a single light emitting device temperature has been determined. If only a single light emitting device temperature has been determined, there are not two temperatures from which a temperature slope may be determined. Consequently, method 400 proceeds to 406 where during the first pass or execution of method 400, the temperature slope is not determined. The variable FirstSample is set to a value of false when the lighting system is first powered up. Once method 400 is executed and FirstSample is asserted true, FirstSample remains true. If method 400 judges variable FirstSample is true, the answer is yes and method 400 proceeds to 412. Otherwise, the answer is no and method 400 proceeds to 406. In other examples, the slope may be determined using from 3 to N temperature samples so that a longer term slope trend may be used.

At 406, method 400 stores the light emitting device temperature in to variable in memory named Temp1. In one example, the variable Temp1 is stored in volatile memory as a floating point number, but it may also be stored in other formats such as a binary number. Further, in other examples where more than one temperature is processed, from two to N temperatures may be stored to memory. Method 400 proceeds to 408 after the light emitting device temperature is stored to memory.

At 408, method 400 retrieves the present time from the CPU and stores it to a variable in volatile memory named Time1. The variable Time1 may be stored as a floating point number or in another format. Method 400 proceeds to 410 after the present time is stored to memory.

At 410, method 400 changes the state of FirstSample to true. Once the variable FirstSample is true, the path from 406-410 is no longer executed and method 400 begins to determine a temperature slope each time it is executed. In some examples, method 400 may be executed each time a sample of the temperature sensor is taken. Alternatively, method 400 may be executed at a different interval. Method 400 proceeds to exit after FirstSample is set true and method 400 is executed when it is called again.

At 412, method 400 stores the latest or most current light emitting device temperature (e.g., the light emitting device temperature determined at 402) into a variable named Temp2. Temp2 is a variable having the same format as variable Temp1. In examples where more than one temperature is processed, from two to N most current temperatures are stored to memory. Method 400 proceeds to 414 after the latest light emitting device temperature is stored to memory.

At 414, method 400 determines and stores a change in time to volatile memory. The change in time is stored in a variable named TimeDelta. In one example, the present or current time is retrieved from the CPU, the time value stored in variable Time1 is subtracted from the current time to determine the change in time, and the change in time is stored in the variable TimeDelta. Method 400 proceeds to 416 after the change in time is determined.

At 416, method 400 stores the present or current time into the variable Time1 as described at 408. Method 400 proceeds to 418 after the present time is stored to memory.

At 418, method 400 judges whether or not the value stored in Temp2 is greater than the value stored in Temp1. If the value of Temp2 is greater than the value of Temp1, the light emitting device temperature is increasing and providing a positive slope to the light emitting device temperature history. If the value of Temp2 is not greater than the value of Temp1, the light emitting device temperature is constant or decreasing via a negative slope to the light emitting device temperature history. If method 400 judges that the value stored in Temp2 is greater than the value stored in Temp1, the answer is yes and method 400 proceeds to 420. Otherwise, the answer is no and method 400 proceeds to 436. Similar operations are performed for other sampled temperatures in examples where more than one temperature sensor is sampled and processed.

At 420, method 400 determines the temperature slope of the light emitting device temperature history (e.g., the slope between two light emitting device temperatures). To determine the temperature slope, method 400 determines a change in light emitting device temperature. Specifically, method 400 subtracts the temperature value stored in Temp1 from the temperature value stored in Temp2 to determine the change in light emitting device temperature. The change in light emitting device temperature may be stored in a variable TempDelta. Method 400 also divides the change in light emitting device temperature by the change in time determined at 414 to determine the light emitting device temperature slope. The temperature slope may be expressed as:

$$\text{Slope} = \frac{TempDelta}{TimeDelta}$$

Where Slope is the light emitting device temperature slope, TempDelta is the temperature change between light emitting device temperatures, and where TimeDelta is the change in time between when the two light emitting device temperature were determined. Similar operations are performed for other sampled temperatures in examples where more than one temperature sensor is sampled and processed.

In one example, the value of the variable Slope is indicative of a coolant flow rate through the lighting system. At lower coolant flow rates, the value of slope may increase when the light emitting devices are activated. At higher coolant flow rates, the value of slope may decrease when the light emitting devices are activated. Thus, a coolant flow rate that is less than a desired coolant flow rate may be recognized or determined by a light emitting device temperature slope that exceeds the value of variable MaxSlope described at 422. Method 400 proceeds to 422 after the slope is determined.

At 422, method 400 judges whether or not the temperature slope is greater than a threshold slope. The threshold slope may be stored in a variable named MaxSlope. If method 400 judges that the temperature slope is greater than the threshold slope, the answer is yes and method 400 proceeds to 426. Otherwise, the answer is no and method 400 proceeds to 424. Similar operations are performed for other sampled temperatures in examples where more than one temperature sensor is sampled and processed.

Additionally, in some examples method 400 may judge whether or not the temperature slope is greater than another slope that indicates a different level of coolant flow through the lighting system. For example, method 400 may judge whether or not the value of slope is greater than a threshold value stored in MidSlope. The variable MidSlope represents a desired nominal value of Slope when a predetermined rate of coolant flow through the lighting system is present. If the value of Slope exceeds the value of MidSlope a predetermined number of times, method 400 may output a check coolant flow status to an operator without stopping electrical current flow to the lighting system. Further, a plurality of slope comparisons with different control actions resulting from the comparisons may be made if desired.

Further, in still other examples, method 400 may include a condition where the light emitting device temperature is greater than a threshold temperature while Slope is greater than MaxSlope to proceed to 426. Thus, the light emitting device temperature is greater than a threshold temperature and changing at a rate faster than a threshold rate for method 400 to proceed to 426.

At 424, method 400 equates a variable SlopeExceedCount to a value of zero. The variable SlopeExceedCount is a variable that represents a number of times the light emitting device temperature slope has exceeded the threshold slope value. By equating the variable SlopeExceedCount to zero, method 400 ensures that electrical current supplied to operate the light emitting devices will not be stopped the next time method 400 is executed. Initially, SlopeExceedCount is set to a value of zero when the lighting system is powered-up. Method 400 proceeds to 436 after SlopeExceedCount is equated to zero. Similar operations are performed for other slope exceed variables in examples where more than one temperature sensor is sampled and processed.

At 426, method 400 adds a value of one to the value of variable SlopeExceedCount. The value of SlopeExceedCount is incremented so that it may be determined how many times the light emitting device temperature slope is greater than a threshold slope. Method 400 proceeds to 428 after the variable SlopeExceedCount is incremented. Similar operations are performed for other slope exceed variables in examples where more than one temperature sensor is sampled and processed.

At 428, method 400 judges whether or not the value stored in variable SlopeExceedCount is greater than or equal to a value of 2. Alternatively, the variable SlopeExceedCount can be compared to any number from 1 to N. In this example, SlopeExceedCount is compared with a value of 2 in order to avoid the possibility of false positive indications. The specific value that SlopeExceedCount is compared to may depend on temperature signal characteristics. If method 400 judges that the variable SlopeExceedCount is greater or equal to 2, the answer is yes and method 400 proceeds to 430. Otherwise, the answer is no and method 400 proceeds to 436.

At 430, method 400 turns the SLMs off. In one example, the SLMs are turned off by opening a switch or increasing a resistance of a variable resistance device such as a FET. In other examples, the amount of current supplied to the SLMs may be reduced to a value that is less than a threshold amount of current. It should be noted that the power supply providing current to the light emitting devices may continue to operate while current flow to the light emitting devices is stopped. Method 400 proceeds to 432 after current supplied to SLMs is adjusted.

At 432, method 400 stores a degradation code to memory and reports lighting system status. In one example, the degradation code corresponds to a light emitting device temperature change greater than a threshold level. The system status indicator my provide notice to external systems or an operator that the lighting system is in an off-line mode with limited capabilities. Method 400 proceeds to 434 after the degradation code and status are output.

At 434, method 400 logs the degradation condition to memory and/or transmits the degradation condition to other external systems (e.g., production monitoring systems). The degradation log may include but is not limited to time of day, lighting emitting device temperature at the time of shutdown, lighting system current, lighting system voltage, and lighting system coolant flow rate. Method 400 proceeds to 436 after lighting system degradation is logged.

At 436, method 400 equates the value of variable Temp1 to the value of variable Temp2 so that the slope may be determined the next time method 400 is executed. Variable Temp1 may also be stored in memory. Method 400 proceeds to exit after the value of Temp1 is equated to the value in Temp2.

Thus, the method of FIG. 4 provides for operating a plurality of light emitting devices, comprising: supplying an electrical current to the plurality of light emitting devices; and stopping flow of the electrical current in response to a rate of temperature increase of the plurality of light emitting devices exceeding a threshold rate of temperature increase. The method includes where the flow of the electrical current is stopped via an electrical switching device, where the rate of temperature increase is expressed as a slope, and where the slope is indicative of a rate of coolant flow through a lighting system. The method also includes where the electrical switching device is a FET.

In some examples, the method includes where stopping the flow of the electrical current in response to the rate of temperature increase of the plurality of light emitting devices exceeding a threshold rate of temperature increase includes stopping the electrical current in response to two consecutive indications of exceeding the threshold rate of temperature increase without the rate of temperature increase of the plurality of light emitting devices decreasing. The method also includes where the plurality of light emitting devices emit ultraviolet light, and further comprising stopping flow of the electrical current until a DC power supply providing the electrical current to the plurality of light emitting devices is cycled off and on. The method further comprises continuing to supply the electrical current to the plurality of light emitting devices if the rate of light emitting device temperature increase exceeds the threshold rate of temperature increase only a single time over a duration of two consecutive determinations of light emitting device temperature. The method includes where a determination of light emitting device temperature is based on an average of four samples of light emitting device temperature.

In another example, the method of FIG. 4 provides for operating an array of light emitting devices, comprising: supplying an electrical current to the array of light emitting devices; stopping flow of the electrical current in response to a rate of light emitting device temperature increase exceeding a threshold rate of temperature increase; and indicating a condition of light emitting device degradation to an operator. The method further comprises requiring a temperature of the array of light emitting diodes to exceed a threshold temperature while the rate of light emitting device temperature increase exceeds the threshold rate of temperature increase before stopping flow of the electrical current.

In some examples, the method includes where indicating the condition of light emitting device degradation includes logging a temperature condition to memory of a controller. The method also includes where stopping the flow of the electrical current in response to a rate of light emitting device temperature increase includes stopping the electrical current in response to two consecutive indications of exceeding the threshold rate of temperature increase without the rate of light emitting device temperature decreasing to a value less than the threshold rate of temperature increase. The method further comprises continuing to operate a DC voltage source supplying power to the array of light emitting devices after stopping flow of the electrical current. The method further comprises stopping flow of the electrical current until the DC power supply is cycled off and on.

Figure 5:
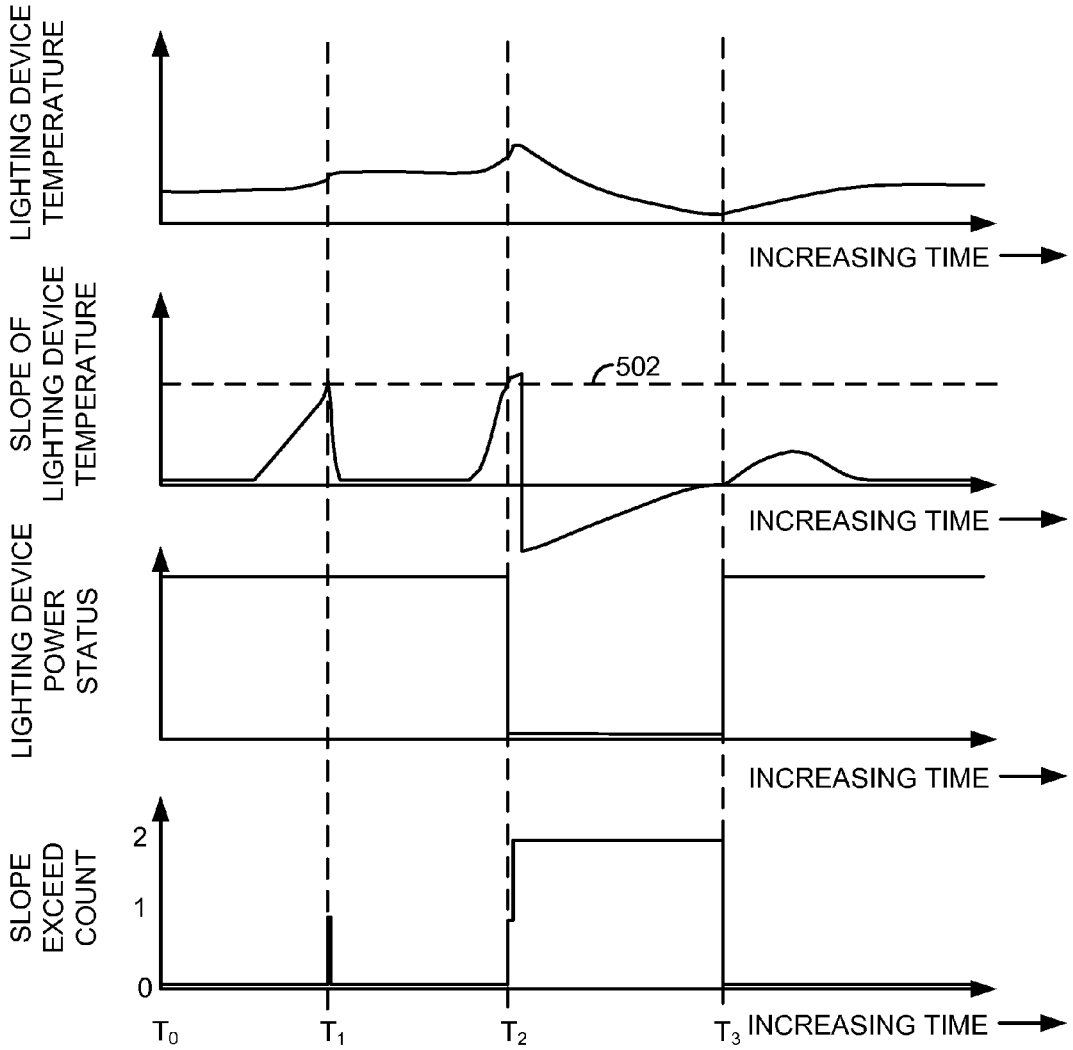
FIG. 5 shows an example operating sequence for a lighting system.

Referring now to FIG. 5, an example operating sequence for the method of FIG. 4 and the lighting system of FIGS. 1-3 is shown. Vertical markers at times $T_0$-$T_3$ represent times of interest during the sequence.

The first plot from the top of FIG. 5 represents light emitting device temperature versus time. The Y axis represents light emitting device temperature and light emitting device temperature increases in the direction of the Y axis arrow. The X axis represents time and time increases from the left hand side of FIG. 5 to the right hand side of FIG. 5.

The second plot from the top of FIG. 5 represents a slope of light emitting device temperature versus time. The Y axis represents slope of light emitting device temperature and slope of light emitting device temperature increases in the direction of the Y axis arrow. The X axis represents time and time increases from the left hand side of FIG. 5 to the right hand side of FIG. 5. Horizontal line 502 represents a light emitting device temperature slope threshold level. The slope of light emitting device temperature may also be described as the rate of change of light emitting device temperature.

The third plot from the top of FIG. 5 represents light emitting device power status versus time. The Y axis represents light emitting device power status and light emitting devices are activated when the light emitting device power trace is at a higher level. Light emitting devices are deactivated when the light emitting device power trace is at a lower level. The X axis represents time and time increases from the left hand side of FIG. 5 to the right hand side of FIG. 5.

The fourth plot from the top of FIG. 5 represents a slope exceeded counter value versus time. The Y axis represents slope exceeded counter value and the slope exceeded counter can vary between a value of 0 and 2 as numerically indicated on the Y axis. However, in other examples, the slope exceed counter may be selected to be between 1 and N. The X axis represents time and time increases from the left hand side of FIG. 5 to the right hand side of FIG. 5.

At time $T_0$, light emitting device temperature is at a middle level and at a constant level. The light emitting device temperature slope is zero and the light emitting devices are in an activated state. The slope exceeded count is zero since the light emitting device temperature slope is less than the light emitting device slope threshold 502.

Between time $T_0$ and time $T_1$, the light emitting device temperature begins to increase. The light emitting device temperature slope increases in a positive direction as the light emitting device temperature increases. In one example, the light emitting device temperature increase may be in response to increasing current flow to the light emitting devices for the purpose of increase light intensity output of the light emitting devices. The light emitting devices remain active as indicated by the light emitting device power status being at a higher level. The slope of exceeded counter value remains at a value of zero since the light emitting device temperature slope is less than the light emitting device temperature slope threshold 502.

At time $T_1$, the light emitting device temperature is increased to a higher temperature and the light emitting device temperature slope increases to a level greater than the light emitting device temperature slope threshold 502. The light emitting device power status trace remains at an elevated level indicating that current continues to flow to the light emitting devices. The light emitting device slope exceeded count increases to a value of one in response to the light emitting device temperature slope and it indicates that the light emitting device temperature rate of change is greater than a threshold rate of change indicated by horizontal line 502.

Shortly after time $T_1$, the light emitting device temperature is determined to be increasing at a rate slower than the threshold rate indicated by horizontal line 502. The light emitting device temperature slope or rate of change may be reduced via lowering the amount of current supplied to the light emitting devices or via improving heat transfer away from the light emitting devices. Consequently, the light emitting device temperature slope decreases to a level less than the level indicated by line 502 by the time the next light emitting device temperature is processed. As a result, the slope exceeded count is reset to a value of zero and the light emitting devices remain activated as indicated by the light emitting device power status remaining at a higher level.

Between time $T_1$ and time $T_2$, the light emitting device temperature remains at a constant level and then increase before time $T_2$ is reached. The light emitting device temperature may be increased via increasing the amount of current supplied to the light emitting devices or in response to reduced light emitting device cooling. The light emitting devices remain active and the slope exceeded count remains at zero.

At time $T_2$, the light emitting device temperature increases and the light emitting device temperature slope increases to a value greater than the temperature slope threshold 502. The slope exceeded count increases to a value of one and the light emitting device power status remains at a higher level to indicate that the light emitting devices remain active even though the light emitting device temperature slope has been exceeded for one determination of light emitting device temperature. The light emitting device temperature continues to increase for a subsequent determination of light emitting device temperature after time $T_1$, and the light emitting device temperature slope remains at a value greater than the light emitting device temperature slope threshold 502. The slope exceeded count is incremented to a value of two in response to the second determination of light emitting device temperature slope exceeding threshold 502 and the light emitting device power status transitions to a low level in response to the light emitting device temperature slope exceeded count reaching a value of two. Current supplied to the light emitting devices is stopped in response to the light emitting device power status transitioning to a lower level.

Between time $T_2$ and time $T_3$, the light emitting device temperature decreases and the light emitting device temperature slope becomes negative and decreases to a level less than light emitting device temperature slope threshold 502. The light emitting devices remain off as no current flows to the light emitting devices as indicated by the light emitting device power status being at a lower level. The slope exceeded count remains at a value of two.

At time $T_3$, an operator cycles power to the power supply providing DC power to the light emitting devices (not shown). The slope exceeded count is reset to zero in response to cycling the power supply from on to off and back to on. The light emitting device power status also transitions to a higher level to indicate that current may flow to the light emitting devices. The light emitting device temperature begins to increase and the light emitting device temperature slope increases and then decreases.

In this way, the light emitting device temperature slope or rate of increase may be monitored and it may be the basis for selectively allowing or stopping current flow to light emitting devices. In some examples, a light emitting device temperature threshold may also have to be exceeded in addition to the light emitting device temperature slope threshold being exceeded to stop current flow to the light emitting devices. Such a procedure may reduce the possibility of light emitting device degradation.

As will be appreciated by one of ordinary skill in the art, the methods described in FIG. 4 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, lighting sources producing different wavelengths of light may take advantage of the present description.

The invention claimed is:

1. A method for operating a plurality of light emitting devices, comprising:

supplying an electrical current to the plurality of light emitting devices; and stopping flow of the electrical current in response to a rate of temperature increase of the plurality of light emitting devices exceeding a threshold rate of temperature increase.

2. The method of claim 1, where the flow of the electrical current is stopped via an electrical switching device, where the rate of temperature increase is expressed as a slope, and where the slope is indicative of a rate of coolant flow through a lighting system.

3. The method of claim 2, where the electrical switching device is a FET.

4. The method of claim 1, where stopping the flow of the electrical current in response to the rate of temperature increase of the plurality of light emitting devices exceeding a threshold rate of temperature increase includes stopping the electrical current in response to two consecutive indications of exceeding the threshold rate of temperature increase without the rate of temperature increase of the plurality of light emitting devices decreasing.

5. The method of claim 1, where the plurality of light emitting devices emit ultraviolet light, and further comprising stopping flow of the electrical current until a DC power supply providing the electrical current to the plurality of light emitting devices is cycled off and on.

6. The method of claim 4, further comprising continuing to supply the electrical current to the plurality of light emitting devices if the rate of light emitting device temperature increase exceeds the threshold rate of temperature increase only a single time over a duration of two consecutive determinations of light emitting device temperature.

7. The method of claim 6, where a determination of light emitting device temperature is based on an average of four samples of light emitting device temperature.

8. A method for operating an array of light emitting devices, comprising:

supplying an electrical current to the array of light emitting devices;

stopping flow of the electrical current in response to a rate of light emitting device temperature increase exceeding a threshold rate of temperature increase; and indicating a condition of light emitting device degradation to an operator.

9. The method of claim 8, further comprising requiring a temperature of the array of light emitting diodes to exceed a threshold temperature while the rate of light emitting device temperature increase exceeds the threshold rate of temperature increase before stopping flow of the electrical current.

10. The method of claim 8, where indicating the condition of light emitting device degradation includes logging a temperature condition to memory of a controller.

11. The method of claim 8, where stopping the flow of the electrical current in response to a rate of light emitting device temperature increase includes stopping the electrical current in response to two consecutive indications of exceeding the threshold rate of temperature increase without the rate of light emitting device temperature decreasing to a value less than the threshold rate of temperature increase.

12. The method of claim 11, further comprising continuing to operate a DC voltage source supplying power to the array of light emitting devices after stopping flow of the electrical current.

13. The method of claim 12, further comprising stopping flow of the electrical current until the DC power supply is cycled off and on.

14. A system for operating light emitting devices, comprising:

a DC power supply;

a plurality of light emitting devices selectively receiving electrical current from the DC power supply; and a controller including executable instructions stored in non-transitory memory for stopping the electrical current from the DC power supply to the plurality of light emitting devices in response to a rate of temperature increase of the plurality of light emitting devices.

15. The system of claim 14, further comprising additional executable instructions for sampling a temperature of the plurality of light emitting devices and requiring a temperature of the plurality of light emitting diodes to exceed a threshold temperature while the rate of light emitting device temperature increase exceeds a threshold rate of temperature increase before stopping flow of the electrical current.

16. The system of claim 14, further comprising an electrical switch and additional executable instructions for stopping electrical current flow from the DC power supply to the plurality of light emitting devices via the electrical switch.

17. The system of claim 14, further comprising additional executable instructions for stopping the electrical current flow in response to two consecutive indications of exceeding a threshold rate of temperature increase without the rate of temperature increase of the plurality of light emitting devices decreasing to a value less than the threshold rate of temperature increase.

18. The system of claim 14, further comprising additional executable instructions for stopping flow of the electrical current until the DC power supply providing the electrical current is cycled off and on.

19. The system of claim 14, further comprising additional executable instructions for indicating a condition of light emitting device degradation when the rate of temperature increase of the plurality of light emitting devices exceeds a threshold rate of temperature increase.

20. The system of claim 14, further comprising additional executable instructions for continuing to operate the DC power supply after stopping the electrical current.

* * * * *